US007455426B2

(12) United States Patent
Lai

(10) Patent No.: US 7,455,426 B2
(45) Date of Patent: Nov. 25, 2008

(54) DECORATIVE LIGHT STRING WITH A SCREW HEAD

(76) Inventor: Wen-Cheng Lai, A1, 12F, No. 129, Sec. 1, Hsin-Nan Road, Nan-Chien Village, Lu-Chu Country, Taoyuan Hsien (TW)

( * ) Notice: Subject to any disclaimer, the term of this patent is extended or adjusted under 35 U.S.C. 154(b) by 165 days.

(21) Appl. No.: 11/464,206

(22) Filed: Aug. 14, 2006

(65) Prior Publication Data

US 2008/0037249 A1 Feb. 14, 2008

(51) Int. Cl.
*F21V 21/00* (2006.01)

(52) U.S. Cl. ..... 362/249; 362/252; 362/391

(58) Field of Classification Search ..... 362/249, 362/252, 800, 391, 227; 315/185 R, 192, 315/170

See application file for complete search history.

(56) References Cited

U.S. PATENT DOCUMENTS 5,575,459 A * 11/1996 Anderson ..... 362/240
5,726,535 A * 3/1998 Yan ..... 315/185 R
5,806,965 A * 9/1998 Deese ..... 362/249
6,036,336 A * 3/2000 Wu ..... 362/249
7,118,249 B2 * 10/2006 Hsu et al. ..... 362/249
2003/0021113 A1 * 1/2003 Begemann ..... 362/231
2003/0021117 A1 * 1/2003 Chan ..... 362/260
2007/0103901 A1 * 5/2007 Reid ..... 362/234

* cited by examiner

*Primary Examiner*—Thomas M Sember

(57) ABSTRACT

A light string with a screw head is provided, including a light string and a screw head. The light string includes a plurality of LEDs connected in series by a plurality of wires. The wires connected to the screw head. The screw head further includes an insulating body, a screw shell and a contacting end. The insulating body further includes a circuit to regulate the current before providing to the LEDs. The light string with a screw head of the present invention can be used with conventional light string to extend the use of the conventional light string and provide more varieties for decorative and lighting purposes.

6 Claims, 8 Drawing Sheets

DECORATIVE LIGHT STRING WITH A SCREW HEAD

FIELD OF THE INVENTION

The present invention generally relates to a light string, and more specifically to a light string with a screw head able to draw power from a conventional socket for a screw-on light bulb.

BACKGROUND OF THE INVENTION

The LED provides many advantages over the conventional tungsten light bulb, such as longer life span, power efficiency, durability, reliability, smaller size, and shorter reaction time, and so on. The LED has been widely used in decorative light string, especially with the recent choices of color varieties. However, conventional LED light strings are seldom compatible with the other types of light strings in terms of the voltage, current and the electrical connections. To improve the usability of the LED light string, it is imperative to develop LED light strings that can be used in conjunctions with conventional tungsten light-bulb light strings.

The conventional light strings made with larger tungsten light bulbs are brighter and popular among many consumers. Each tungsten light bulb is with a screw head to screw on the sockets in the light string. The advantage is that each light bulb can be replaced when necessary. The present invention is designed to be compatible with the light bulb with a crew head. In other words, the light string of the present invention can be used to replace the tungsten light bulb with screw head to provide the conventional light strings more varieties of decorative choices.

SUMMARY OF THE INVENTION

The primary object of the present invention is to provide a light string that can be used with the conventional light strings, including a plurality of LED lights strung together with a screw head on one end of the string. The screw head matches the conventional socket for tungsten light bulbs used in a light string. Therefore, the light string of the present invention can be used to replace a tungsten light bulb to provide additional decorative choice to the conventional light string with tungsten light bulbs. In addition, the light string of the present invention can help to simplify the wiring of the light string.

Another object of the present invention is to provide a light string with screw head that is safe to use with the conventional light string. The light string of the present invention includes a well-hidden circuit for controlling the voltage of the current, and a fuse is also included to guarantee the safety of use in case of overloading. The light string can be varied to become fish-net, curtain type or other three dimensional decoration item. Additional control box can be included to control the lighting, such as blinking, light intensity change, for various lighting and decorative purposes and occasions.

To achieve the aforementioned objects, the present invention provides a light string with a screw head. The screw head includes an insulating body, a screw shell, and a contacting end. The inside of the insulating body includes a circuit to regulate the input alternating current to a pre-determined direct current to drive the LED light string. The screw shell can be used in a conventional light bulb socket so that the contacting end is electronically connected to the input alternating current power source.

The foregoing and other objects, features, aspects and advantages of the present invention will become better understood from a careful reading of a detailed description provided herein below with appropriate reference to the accompanying drawings.

BRIEF DESCRIPTION OF THE DRAWINGS

The present invention can be understood in more detail by reading the subsequent detailed description in conjunction with the examples and references made to the accompanying drawings, wherein.

DETAILED DESCRIPTION OF THE PREFERRED EMBODIMENTS

Figure 1:
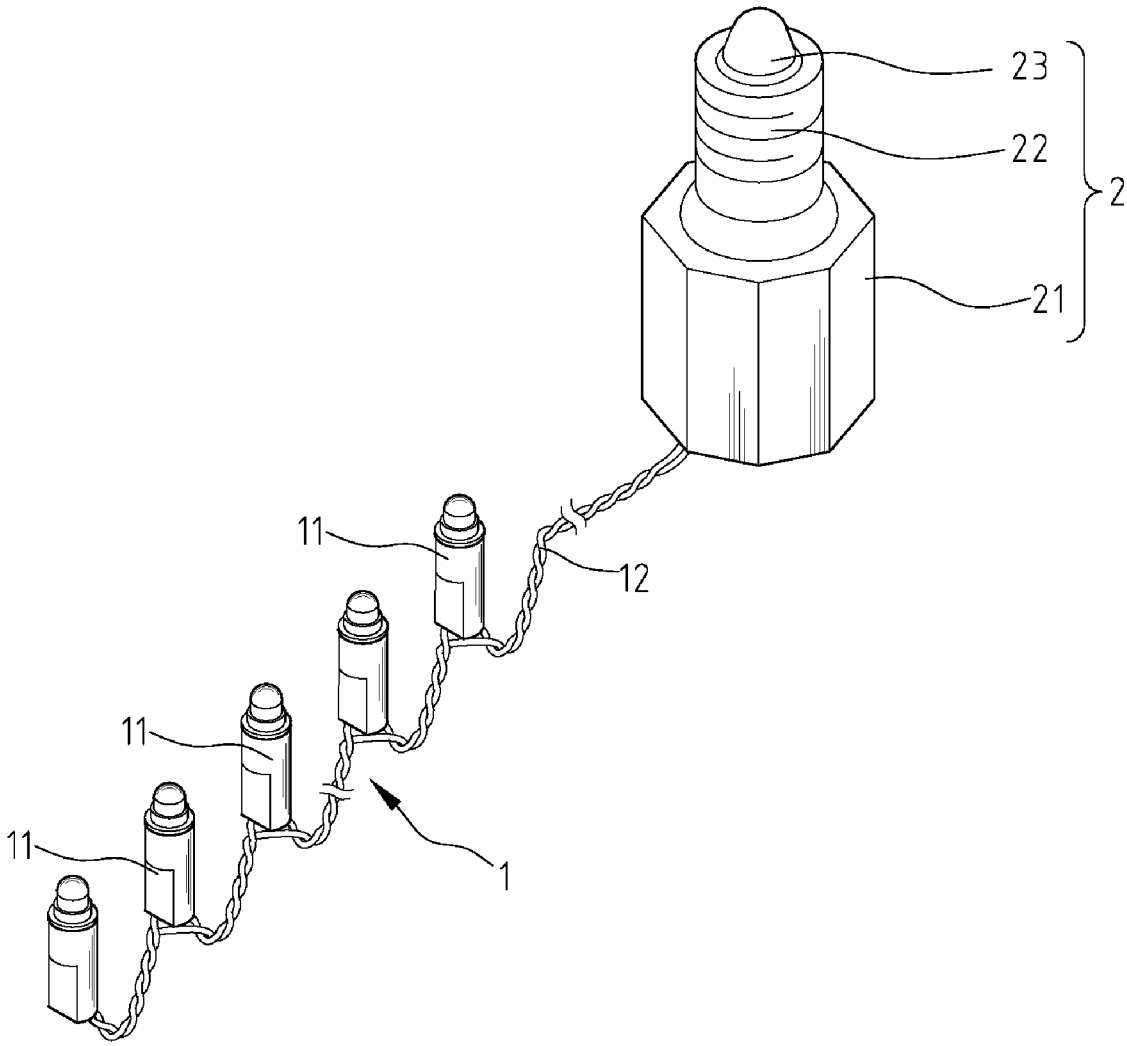
FIG. 1 shows a three-dimensional schematic view of the present invention.

FIG. 1 shows a three-dimensional schematic view of the present invention. The present invention includes a light string 1 and a screw head 2. Light string 1 includes a plurality of LEDs 11. Each LED 11 is connected in series by at least two wires 12. Wires 12 are connected to screw head 2. Screw head 2 includes an insulating body 21, a metal screw shell 22 and a contacting end 23. Contacting end 23 is not directly in contact with screw shell 22, which is the standard screw head design. The size of the screw head can be varied to match the different sizes of the standard socket. The inside of insulating body 21 includes a circuit. The input ends of the circuit are connected to the inner wall of screw shell 22 and contacting end 23, respectively. Inside of insulating body 21 is the insulating, thermal-endurable, and non-flammable material to seal the circuit for water-proof. Therefore, light string 1 can be used for outdoor conditions. The shape of insulting body 21 is not limited to any specific shape. Wires 12 are connected to the output ends of the circuit inside insulting body 21. The circuit is for regulating the current and lowering the voltage so that the alternating current from the input ends can be transformed to the low voltage direct current that is suitable for LED. The present invention uses screw head 2 to draw power from conventional light-bulb socket. Therefore, the present invention can extend the usage of the conventional light string, and provide more varieties for lighting and decorative purposes.

Figure 2:
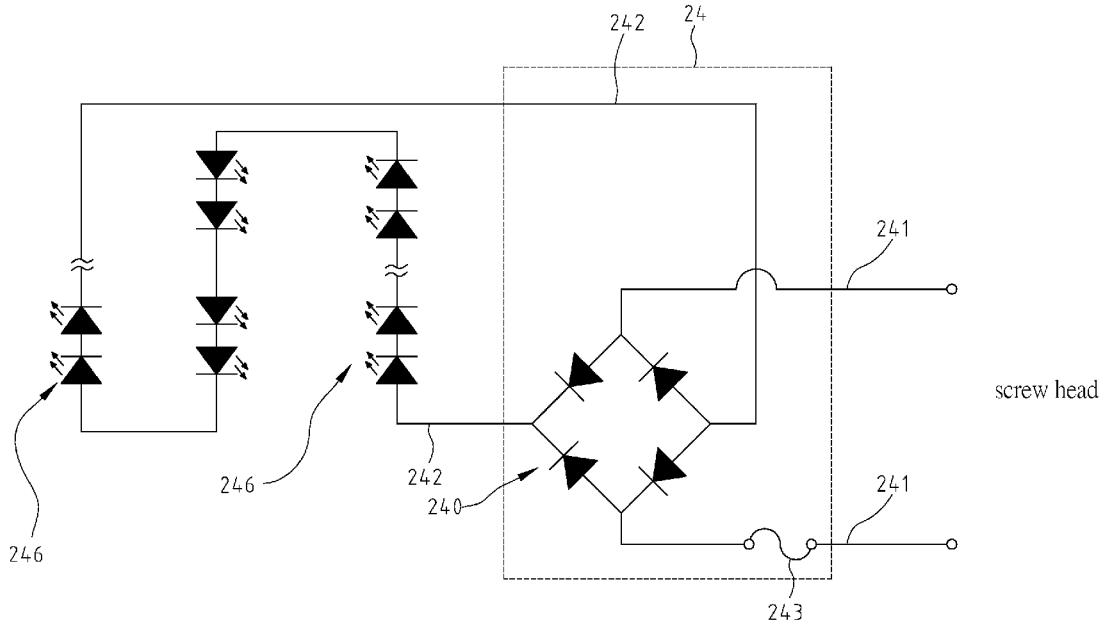
FIG. 2 shows a schematic view of the first embodiment of the circuit of the present invention.

As the current from the conventional light-bulb socket from the conventional light string is alternating current, and the LED uses low-voltage direct current, the circuit inside insulating body 21 of screw head 2 of the present invention must regulate the current and lower the voltage. There are many ways to implement the circuit. The present invention describes a few embodiments for explanation, but the scope of the present invention is not limited to the embodiments described here. FIG. 2 shows a schematic view of the first embodiment of the circuit of the present invention. As shown in FIG. 2, circuit 24 includes a regulating circuit 240 formed by a plurality of diodes. The alternating current drawn from input ends 241 is transformed into direct current. If the number of LEDs 246 is small, the large current may damage LEDs 246. It is, therefore, preferably to have more than 50 LEDs 246 in a light string of the present invention. In other words, screw head 2 is preferably connected to a light string with at least 50 LEDs. To further improve the safety, a fuse 243 may be included close to input ends 241 to open the circuit when the circuit is overloaded.

Figure 3:
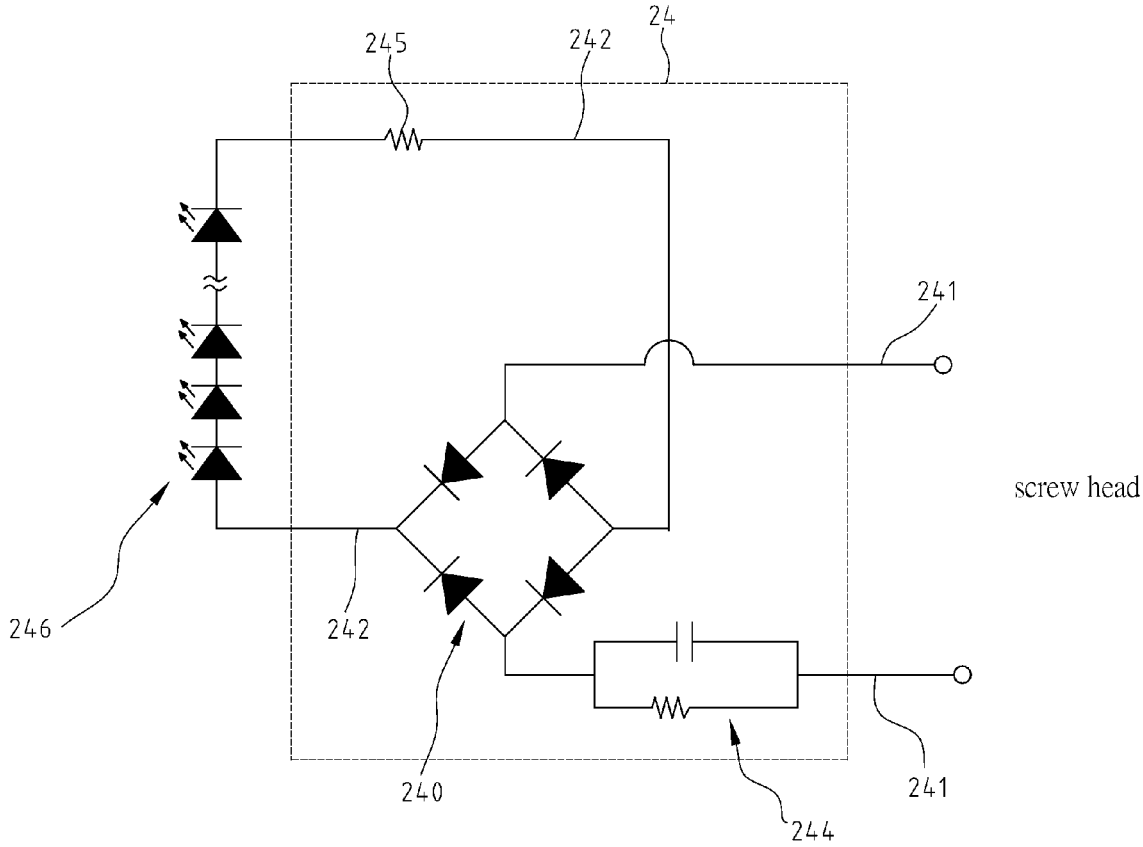
FIG. 3 shows a schematic view of the second embodiment of the circuit of the present invention.

FIG. 3 shows a schematic view of the second embodiment of the circuit of the present invention. As shown in FIG. 3, when the number of LEDs 246 is less than 5, circuit 24 further includes a first auxiliary circuit 244 and a second auxiliary circuit 245 in addition to regulating circuit 240. First auxiliary circuit 244 is a filter circuit, and is connected in series with input end 241, and second auxiliary circuit 245 is a resistor, and is connected in series with one of output ends 242. The resistance of the resistor must match the number of LEDs 246 so that circuit 24 can lower the current supply to the light string with less than 50 LEDs.

Figure 4:
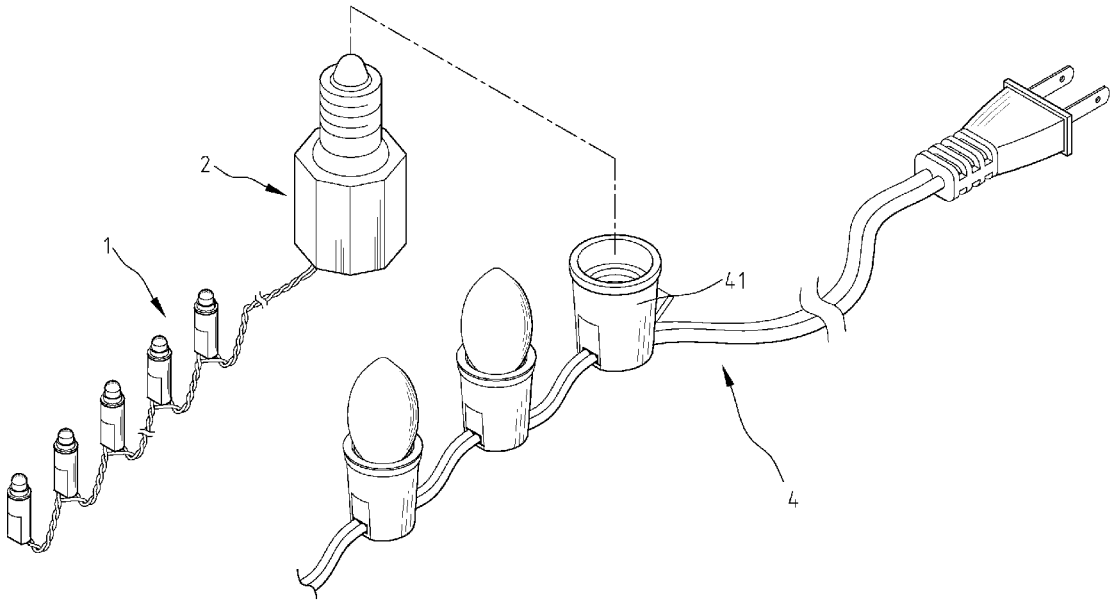
FIG. 4 shows a schematic view of the application of the present invention.

FIG. 4 shows a schematic view of the application of the present invention. As shown in FIG. 4, string light 1 can use screw head 2 to screw into light-bulb socket 41 of conventional light string 4. By screwing off a light-bulb from light-bulb socket 41 and screwing screw head 2 into light-bulb socket 41, an LED light string of the present invention can be used to replace a light bulb in a conventional light string and extend the use of the conventional light string. FIG. 4 only depicts an embodiment of light-bulb socket 41. The shape of light-bulb socket 41 can have different shape or sizes, and screw head 2 can be made to match the shape and the size of light-bulb socket 41. Similarly, the circuit inside the screw head may also have a different implementation due to the different voltage in different areas of the world.

Figure 5:
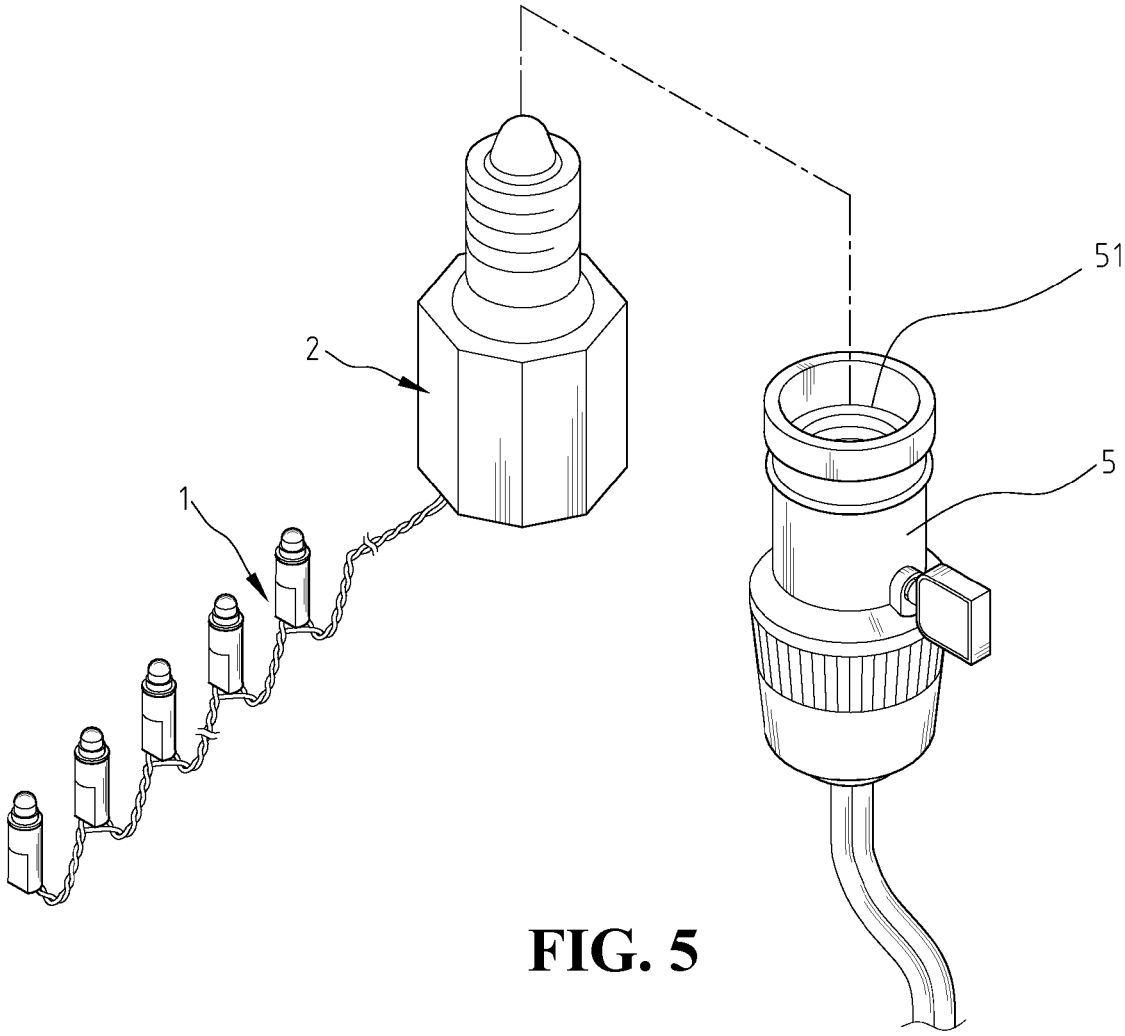
FIG. 5 shows another application of the present invention.

FIG. 5 shows another application of the present invention. This embodiment uses a larger conventional light seat 5 with a screw socket 51 at the top for screw head 2 of the present invention to screw into. As the output voltage is higher in this type of light seat, the circuit inside screw head 2 must also be adjusted to take this into account in order to transform the alternating current into the appropriate direct current for the LEDs. Therefore, the light string of the present invention can be used with any type of conventional light seat with a screw socket.

Figure 6:
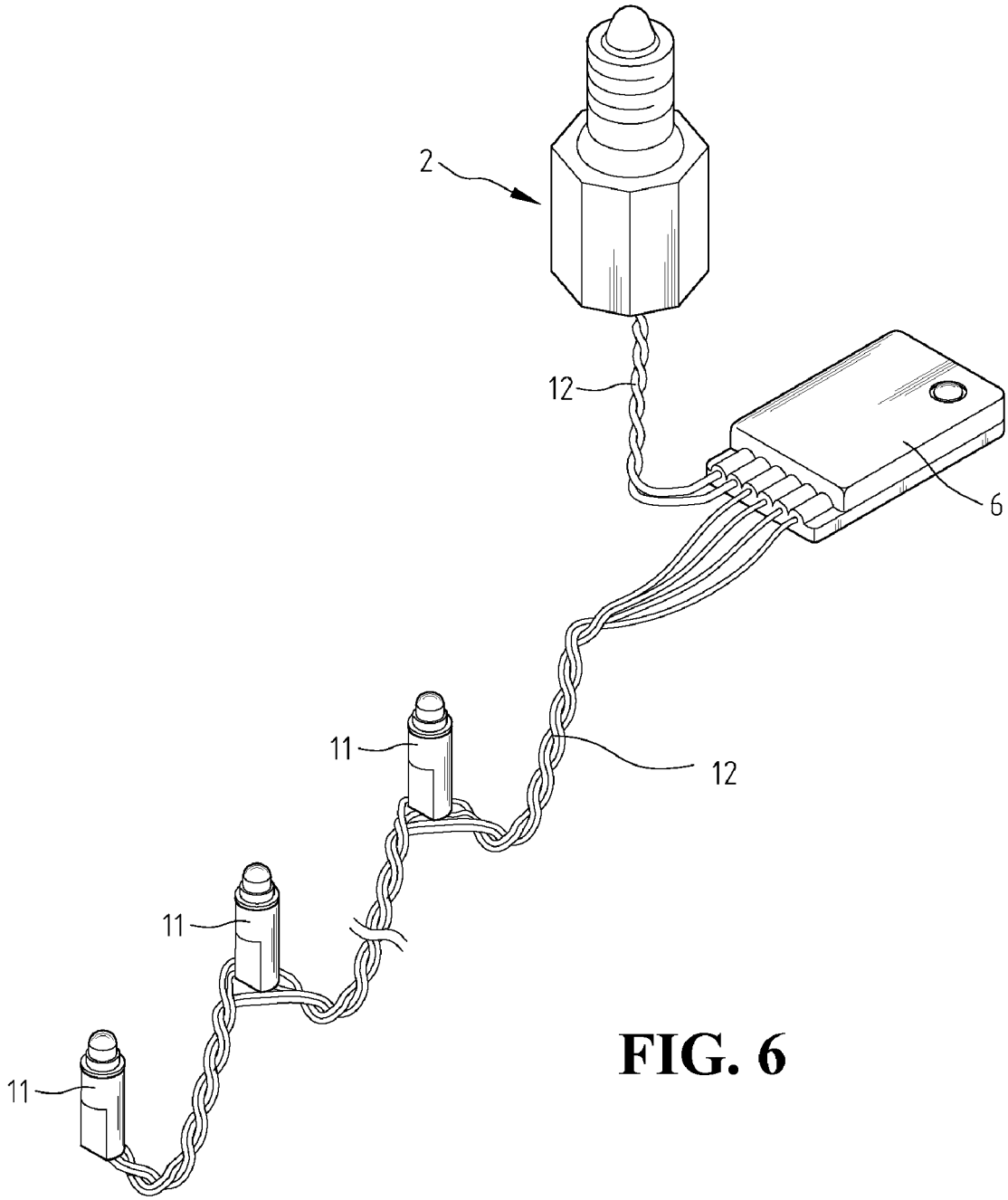
FIG. 6 shows another embodiment of the present invention.

FIG. 6 shows another embodiment of the present invention. In this embodiment, wire 12 connected to screw head 2 is connected to a control box 6. Control box 6 includes a plurality of wires 12 extending to connect LEDs 11. When in use, screw head 2 draws on the power from the conventional light-bulb socket, and control box 6 can be designed to control the lighting of the LEDs, such as blinking, dimming, and other effects.

Figure 7:
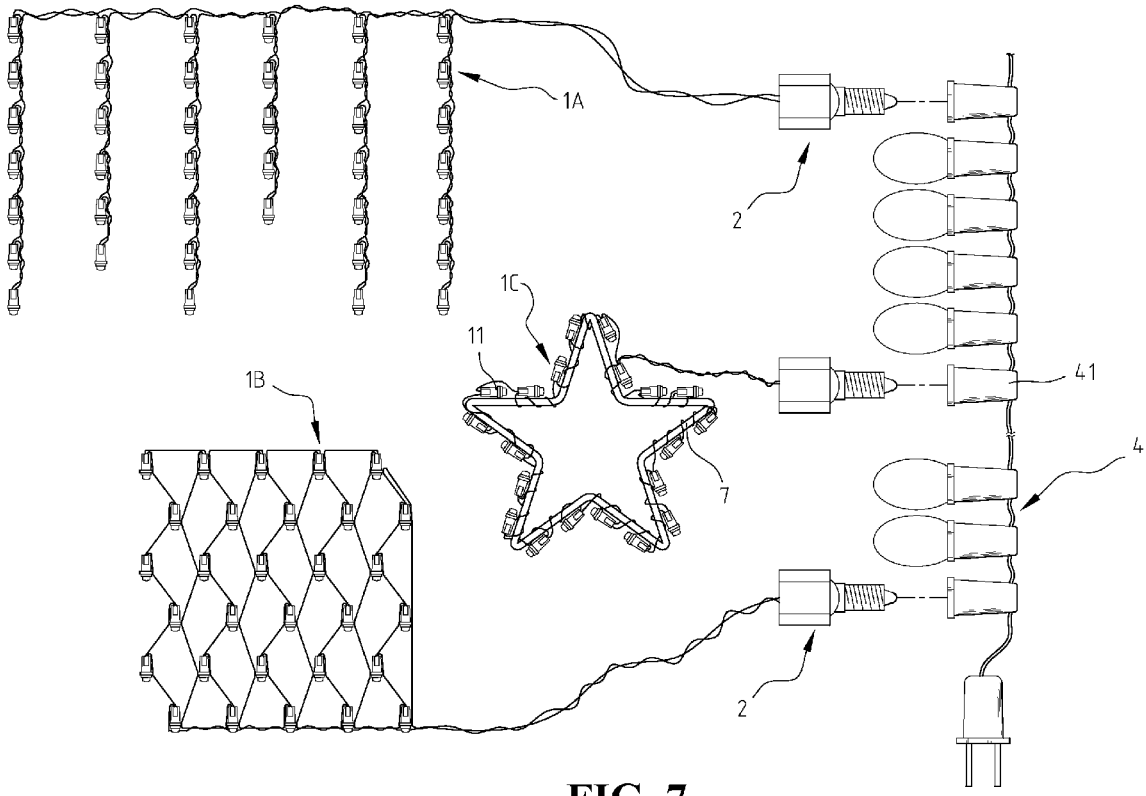
FIG. 7 shows yet another embodiment of the present invention.

FIG. 7 shows yet another embodiment of the present invention. In this embodiment, light string 1 can be assembled into various shapes, such as drape 1A, fish net 1B, or a wrapping around an object 7, such as a star 1C. Object 7 is not limited to any specific shape.

Figure 8:
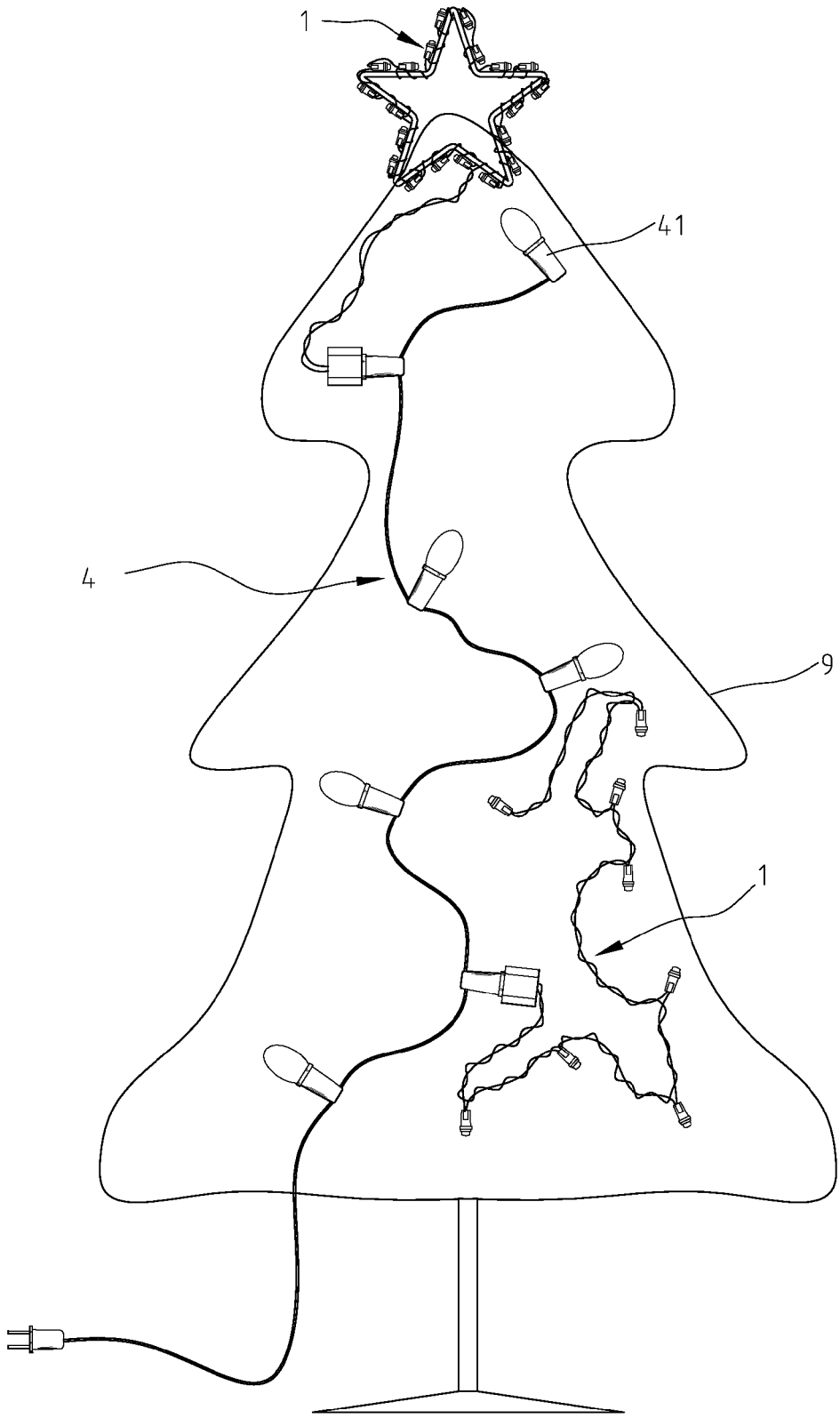
FIG. 8 shows a light string of the present invention used in a Xmas tree.

FIG. 8 shows a light string of the present invention used in a Xmas tree. As shown in FIG. 8, a Xmas tree 9 is decorated with a conventional light string 4. To further improve the decorative effects, the user can replace some light bulbs in conventional light string 4 with the light string of the present invention.

In summary, the light string of the present invention includes a screw head that can be used to draw power from a light-bulb socket in a conventional light string, and can be used with conventional light strings to improve decorative effects.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A light string with a screw head, comprising:

a light string, further comprising a plurality of light emitting diodes serially connected with a plurality of wires; and a screw head, further comprising an insulating body, a metal screw shell, and a contacting end, said insulating body comprising a circuit connected respectively with said screw shell and said contacting end for transforming input alternating current into direct current, and output of said circuit being connected to said wires of said light string;

wherein said light string is shapeable by assembling said plurality of wires to position individual light emitting diodes of said plurality of light emitting diodes at different locations for transforming said light string into different shapes.

2. The light string with a screw head as claimed in claim 1, wherein said insulating body comprises insulating and non-flammable material to seal said circuit inside said insulating body.

3. The light string with a screw head as claimed in claim 1, wherein the shape of said screw shell and said contacting end matches the specification of a conventional socket.

4. The light string with a screw head as claimed in claim 1, wherein said circuit in said insulating body further comprises a regulating circuit.

5. The light string with a screw head as claimed in claim 1, wherein said circuit in said insulating body further comprises a fuse.

6. The light string with a screw head as claimed in claim 1, further comprising a control box connected to said plurality of wires for controlling blinking and dimming of said light emitting diodes to create different lighting effects for said light string.

* * * * *